United States Patent [19]

Giller et al.

[11] Patent Number: 4,506,185

[45] Date of Patent: Mar. 19, 1985

[54] ELECTRIC REFLECTOR LAMP

[75] Inventors: Henricus F. J. I. Giller; Antonius J. M. van Hees; Bauke J. Roelevink, all of Eindhoven, Netherlands

[73] Assignee: U.S. Philips Corporation, New York, N.Y.

[21] Appl. No.: 367,320

[22] Filed: Apr. 12, 1982

[30] Foreign Application Priority Data

Apr. 16, 1981 [NL] Netherlands ..... 8101884
Mar. 11, 1982 [NL] Netherlands ..... 8201010

[51] Int. Cl.[3] ..... H01K 1/28; H01K 1/32
[52] U.S. Cl. ..... 313/113; 313/634
[58] Field of Search ..... 313/113, 114, 117, 634

[56] References Cited

U.S. PATENT DOCUMENTS 1,436,308 11/1922 Evans ..... 313/114
2,120,836 6/1938 Grimes ..... 313/114
2,398,970 4/1946 Singer ..... 313/114

*Primary Examiner*—David K. Moore
*Assistant Examiner*—K. Wieder
*Attorney, Agent, or Firm*—Robert S. Smith

[57] ABSTRACT

An electric reflector lamp according to the invention has a blown lamp envelope comprising a concave internally mirror-coated wall portion, a spherical internally mirror-coated wall portion opposite thereto, an annular translucent wall portion between the first two portions and a tubular wall portion at the apex of the concave wall portion. These wall portions constitute a single blow moulding. The axes of the mirror-coated wall portions coincide, just like their focus and center of curvature, around which a light source is arranged. The concave wall portion is parabolic or elliptic, the second focus lying outside the lamp envelope. The parts of the mirror-coated wall portions, which throw light rays after at most two reflections through the translucent wall portion to the exterior, surround the focus through a solid angle of more than 1.5 $\pi$sr. The spherical wall portion constitutes a mask which prevents light rays from the light source from reaching the translucent wall portion other than after reflection. The lamp does not emit stray light and very effectively concentrates the radiated light.

8 Claims, 10 Drawing Figures

ELECTRIC REFLECTOR LAMP

Figure 1:
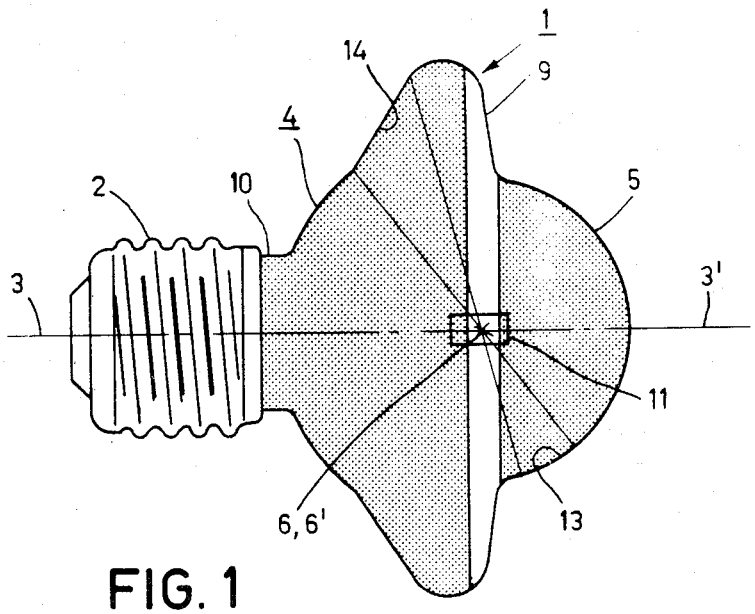
FIG. 1 PRIOR ART

This invention relates to an electric reflector lamp having a lamp envelope comprising a first, mirror-coated internally concave wall portion having an optical axis and a focus, opposite thereto a second, mirror-coated substantially spherical wall portion, the axis and the center of curvature of which at least substantially coincide with the axis and the focus, respectively, of the internally concave wall portion and the largest external dimension of which transverse to the axis is smaller than the largest internal dimension transverse to the optical axis of the internally concave wall portion, a third, annular translucent wall portion between the internally concave wall portion and the spherical wall portion, and a fourth, tubular wall portion extending from the apex of the internally concave wall portion to the exterior, these wall portions together constituting a single blow moulding this lamp envelope accommodating a light source, which surrounds the focus and the center of curvature and from which current-supply conductors extend through the wall of the lamp envelope to the exterior.

Such a lamp is known from U.S. Pat. No. 1,436,308 published in 1922.

The known lamp has for its object to concentrate light from the light source and to emit it in forward direction through the translucent wall portion (the window). For this purpose, the mirror-coated spherical wall portion has to reflect in backward direction light which is emitted by the light source in forward direction. Incident light, which either originates directly from the light source or is reflected by the spherical wall portion, has to be directed through the window to the exterior by the mirror-coated concave wall portion. This requires an optical co-operation of the mirror-coated wall portions and therefore an accurate positioning of these parts with respect to each other as well as an accurate positioning of the light source with respect to the mirror-coated wall portions.

The known lamp has a number of serious disadvantages:

The lamp is not particularly effective in concentrating the light generated by the light source. Commercially available ring mirror lamps, i.e. lamps having a blown envelope comprising only one mirror-coated, parabolic wall portion, are much more effective.

The lamp is mirror-coated at the external surface of the lamp envelope. As a result the mirror coatings are subjected to both mechanical and atmospheric destructive conditions. Furthermore the mirror coatings on the external surface involve the occurrence of double reflections, namely at the internal surface and at the interface between lamp envelope and mirror coating. It is impossible in practice to blow a lamp envelope the internal surface of which has the same form as the external surface, in other words, whose wall has a uniform thickness. This results in double reflection which results in a reduced light concentrating capacity.

The lamp also emits light through the window in transverse direction. Consequently, this stray light does not contribute to the intensity of the light beam.

Moreover, the stray light reduces the comfort the lamp would offer if the lamp would throw light only in forward direction onto an object to be illuminated.

An object of the invention is to provide a lamp which at least substantially mitigates these disadvantages. A particular object of the invention is to provide an electric lamp which concentrates the light of the light source more effectively than a ring mirror lamp and moreover is comfortable as a result of the fact that no or substantially no stray light is emitted. A further object is to provide a lamp the mirror coatings of which are protected from mechanical and chemical damage.

In an electric lamp of the kind mentioned in the opening paragraph this is achieved according to the invention in that the internally concave wall portion and the substantially spherical wall portion are internally mirror-coated, in that the internally concave wall portion is substantially parabolic or substantially elliptic, the second forcus being located outside the lamp envelope, in that those parts of the mirror-coated wall portions which throw light beams of the light source onto the translucent wall portions after at most two reflections surround the centre of curvature and the focus through a solid angle of more than $1.5\pi$ sr and in that the substantially spherical wall portion constitutes a mask which prevents substantially completely light beams of the light source from reaching the translucent wall portion other than after reflection. (The term "sr" will be understood to be an abbreviation for steeradian.)

The internal mirror-coating ensures that mechanical damage and chemical attack of the mirrors, as well as the double reflections occurring with an external mirror-coating are avoided. As a result, not only an improved effectiveness with respect to the known lamp is obtained, but also the quality of the mirrors is maintained during the life of the light source. This is essential because light sources having a very long life can be used, for the light source of the lamp according to the invention may be of various kinds: a filament, a filament in an inner envelope which is provided with a halogen-containing gas, a high-pressure discharge vessel with electrodes and an ionisable gas filling, for example, a discharge vessel with a high-pressure sodium vapor discharge or a high-pressure mercury vapor discharge in the presence of metal halides.

The mirror-coating may consist, for example, of a layer of aluminum, silver or gold.

For an efficient use of the energy consumed it is of essential importance that the light generated by a light source is strongly concentrated and is emitted in that direction in which this is necessary or desirable. As the concentration is more effective, a light source of lower power can be used for obtaining the same illumination intensity.

The ring mirror lamps having a blown lamp envelope which are commercially available already have a considerable concentration capacity, in spite of the fact that a large quantity of the light generated by their light source (without reflection at a mirror) is emitted directly in a wide beam. In optimally constructed lamps of this kind, the parabolic mirror surrounds the light source arranged in the focus of the mirror through a solid angle of $1.5\pi$ sr. The value of this space angle is a measure of the concentration capacity of the lamp. The lamp, which is described in the above-mentioned U.S. patent specification, is much less effective in concentrating the emitted light. The part of the concave mirror which can throw light beams through the window to the exterior after they have been reflected at this part, and the part of the spherical mirror which throws light beams to the said part of the concave mirror, together surround the focus and the center of curvature through a solid angle of only $1.3\pi$ sr.

Although for quite some time these has been a desire to concentrate the light of a light source in a blown lamp envelope, which is apparent from the abovementioned U.S. patent published in 1922, the technique so far has not advanced further than the ring mirror lamps. The fact that the search for lamps having a higher concentration capacity has not caused a return to the lamp according to the said U.S. patent, can be explained in part by the much lesser effectiveness of this lamp. Further it has not been understood that, in order to achieve this aim, inter alia the solid angle through which the co-operating parts of the mirror-coated wall portions surround the center of curvature and the focus, has to be increased, and that this can be attained by increasing the ratio between "the largest internal dimension of the internally concave wall portion transverse to the axis" and "the largest external dimension of the spherical wall portion transverse to the axis". Since from practical and aesthetical considerations the largest transverse dimension of the concave wall portion will be limited, for example, to 10 cm, a gain can be achieved in particular by choosing the wall portion to be as small as possible. The increase of the ratio results in the spherical wall portion intercepting a smaller quantity of light reflected by the concave wall portion.

In the lamp according to the U.S. patent specification, the internally concave wall portion is spherically curved through a comparatively large solid angle and is parabolic through a comparatively small solid angle. This means that a large number of light rays continue to travel to and fro between the spherical wall portions and never leave the lamp. In the lamp according to the invention, the concave wall portion is substantially parabolic or substantially elliptic, the second focus lying outside the lamp envelope. In an embodiment having a spherical wall portion of small transverse dimension, this results in that a large effective reflecting concave surface is obtained.

An elliptic mirror-coated wall portion has the advantage of a converging beam, which results in that even higher intensities can be obtained. Another advantage is that, when a small distance is chosen between the foci of the ellipse of, for example, 10 cm, a lamp is obtained which has a comparatively wide beam at a distance of a few meters, such as a "flood"-PAR lamp. In general an elliptic wall portion having an eccentricity lying between 0 and 0.9 will be preferred, the expression "eccentricity" being understood to mean the ratio between the lengths of the minor axis and the major axis of the ellipse.

The concave wall portion may be curved uniformly, but an alternative is a facetted concave surface. With such a facetted surface the light source can be prevented from being sharply displayed, which is of importance in those cases in which the light source is not rotation-symmetrical with respect to the axis of the lamp envelope.

For another part, the fact that the principle of the blown lamp according to the said U.S. patent specification has not been further developed, is explained in that it has not been understood that the substantially spherical wall portion may constitute a mask which screens the window from radiation which directly originates from the light source and is therefore not concentrated. By imparting this function to the spherical wall portion, not only a larger quantity of light is concentrated, but also the emanation of stray radiation (radiation not reflected by the concave mirror) is counteracted. The lamp according to the invention in an embodiment which concentrates the generated light just more effectively than a ring mirrorlamp and which therefore is much more effective than the lamp according to the said U.S. patent specification, already provides a considerable technical improvement; The lamp is comfortable in use due to the substantially complete absence of stray light.

The envelope of the lamp according to the invention comprises a mirror-coating mainly in front of the focal plane of the concave wall portion and a mirror coating behind this plane and has an unmirrored wall portion, i.e. the window, between the two mirror-coated wall portions. The mirror coatings are provided on the internal surface of the wall portions. During the mirror-coating process it is not possible to cover the window, since this window has a larger diameter than the tubular wall portion. It is not possible either to wholly mirror-coat the lamp envelope and to locally etch away the mirror, as is the case with the lamp envelope of a ring mirror lamp. In this case the etching liquid is introduced by means of a pipette up to the desired level into the lamp envelope through the neck extending perpendicularly upwards and is drawn off by means of a pipette after etching. Furthermore it is not possible to provide during the mirror-coating process a screen around the vapor source, since the required accuracy of the positioning of such a screen cannot be achieved. Therefore, a further reason for which the lamp according to the said U.S. patent specification has passed into oblivion is that no possibilities were found to mirror-coat the lamp envelope internally.

The lamp according to the invention can be readily manufactured in that the lamp envelope surprisingly can be provided in a simple manner with the internal mirror coatings. Thus the invention also relates to a method of manufacturing an electric reflector lamp having a lamp envelope comprising a first, mirror-coating internally concave wall portion having an optical axis and a focus, opposite thereto a second, mirror-coated substantially spherical wall portion, the axis and the center of curvature of which at least substantially coincide with the axis and the focus, respectively, of the internally concave wall portion and the largest external dimension of which transverse to the axis is smaller than the largest internal dimension transverse to the optical axis of the internally concave wall portion, a third annular translucent wall portion between the internally concave wall portion and the spherical wall portion and a fourth, tubular wall portion extending from the top of the internally concave wall portion to the exterior, these wall portions together constituting a single blow moulding, the lamp envelope accommodating a light source which surrounds the focus and the centre of curvature and from which current supply conductors extend through the wall of the lamp envelope to the exterior, characterized in that the lamp envelope, the internally concave wall portion of which is substantially parablic or substantially elliptic, the second focus lying outside the lamp envelope, and of which envelope those parts of the mirror-coated wall portions which throw light rays from the light source after at most two reflections onto the translucent wall portion surround the center of curvature and the focus through a solid angle of more than $1.5\pi$ sr, the substantially spherical wall portion constituting a mask which prevents light rays originating from the light source at least substantially completely from reaching the translucent wall portion other than after reflection the envelope being provided internally with said mirror coatings by introducing a metal vapor source into the lamp envelope via the tubular wall portion to surround the center of curvature and the focus so that the substantially spherical wall portion constitutes a mask which screens the translucent wall portion from the metal vapor source, evacuating the lamp envelope and depositing metal from the metal vapor source on the inner wall, removing the vapor source, positioning the light source in the lamp envelope and sealing the lamp envelope.

In this method the property of the substantially spherical part of the lamp envelope is utilized that it screens rays, which propagate at least substantially rectilinearly from the center of curvature, from the window. For this purpose the mirror coating is provided after the lamp envelope has been evacuated. The free path length in the lamp envelope is then of the same order as the largest distance between the focus and the portions to be mirror-coated. In general a residual pressure of 0.1 Pa is sufficiently low for this purpose.

In general the external transverse dimension of the spherical wall portion will be chosen as small as possible, just like the inner diameter of the tubular portion of the lamp envelope. As a result, the light source is surrounded by effective reflecting surfaces through the largest possible space angle. The smallest dimensions, however, are not only prescribed by the dimensions of the light source and of the metal vapor source, but also by the thermal load the spherical wall portion is capable of withstanding. Further the wish of providing the lamp with a wide lamp cap may involve that the tubular portion of the lamp envelope is chosen to be wider than would otherwise be the case. In an incandescent lamp according to the invention, a largest external transverse dimension of the substantially spherical curved wall portion of approximately 35 to 45 mm has proved to be very suitable, a value of approximately 35 mm being chosen with lower powers of, for example, 25 to 40 W and a value of approximately 45 mm being chosen with powers of, for example, up to approximately 75 W. It is also possible that the length of a light source inclusive of current conductors is so great that a larger radius of curvature must be chosen for the spherical wall portion in order that that portion may be given a sufficient depth to accommodate the light source. Thus, in case the light source is a discharge vessel, the total length of this discharge vessel may be very much longer than its diameter. Further its total length inclusive of seals at the ends and current conductors emanating therefrom may be much greater than the length of the discharge arc.

In a special embodiment, the substantially spherical wall portion therefore has a different form around and in the vicinity of the axis of the lamp envelope. In this embodiment, the wall in that region is bulged outwardly. Thus, the lamp envelope provides a larger space for the light source in axial direction. In this connection it should be noted that said region of a spherical wall portion reflects incident light into the tubular portion of the lamp envelope and so has no optically useful effect at all.

The bulged part may have a larger radius of curvature, as a result of which an ogival form is obtained. Another possibility is a smaller radius of curvature so that a spherical protuberance is obtained on the substantially spherical wall portion. A third possibility is a tubular protuberance. In this case it is rendered possible to additionally support the light source by means of a supporting member accommodated therein.

An alternative for the said facetted parts on the concave wall portion to homogenize an inhomogeneous light beam and to prevent an asymmetrical light source from being displayed consists in that the window of the lamp envelope is satined or profiled.

In an embodiment of the lamp according to the invention, a non-transparent tubular wall portion connects the concave wall portion to the window. This embodiment has the advantage that the concave wall portion can be curved according to a parabola or an ellipse having a larger focal distance than is otherwise possible while retaining the same largest transverse dimension. Consequently, the radiation of a light source which is comparatively large transversely to the optical axis is more strongly concentrated.

The function of the spherical wall portion as a mask will hereinafter be explained more fully with reference to the drawings.

The lamp according to the invention can be used in a simple lamp holder, since the lamp does not require an external screening. The lamp holder will generally have a sufficient depth to prevent that light can radiate through the tubular wall portion of the lamp envelope to the surroundings. In order to render the lamp also suitable for use in a shallow lamp holder, the tubular wall portion may be externally provided with a non-transparent coating, for example, a layer of paint.

The lamp according to the invention may be designed for use at a low or high operating voltage, for example, mains voltage, and may be provided at the cylindrical wall portion of the lamp envelope with, for example, an Edison or Swan lamp cap. The lamp is destined to be used for obtaining accent illumination. Very high brightnesses can then be attained. The lamp may be used in stead of the combination of a bowl mirror lamp and a parabolic reflector, the lamp having the great advantage that errors, which may occur with the combination, do not occur or do not influence the emitted beam. Such errors of such a combination are: The lamp cap of the lamp is not concentric with the axis of the bowl mirror; the lamp holder is not concentric with the parabolic reflector; the light source of the lamp does not surround the focus of the reflector. Further the lamp has the advantage that the parabolic mirror other than an external parabolic reflector is not polluted or attacked by the surrounding atmosphere. The lamp can also be utilized instead of ring mirror lamps, the lamp having the advantage of a very much smaller beam and so a higher intensity at and around the axis of the beam and no or substantially no stray light. The lamp can also be utilized instead of pressed glass lamps, such as PAR 38 lamps. With respect to these lamps as well as with respect to ring mirror lamps, the lamp according to the invention has the advantage that it concentrates the light more effectively and at least substantially does not emit unreflected light.

It should be noted that a lamp having a lamp envelope of pressed glass is known from DE-OS No. 1,472,521 and from the U.S. Pat. No. 2,120,836. The lamp envelope is composed of a parabolic internally mirror-coated cup, a front glass consisting of an annular window around a spherical internally mirror-coated portion and a flat plate at the apex of the parabolic cup.

A disadvantage of this known lamp is that the cup and the front glass, which have to co-operate optically and therefore have to be accurately aligned with respect to each other, have to be united in a thermal processing step. The edges of these portions to be jointed have to be flat and it has to be prevented that the heat treatment results in a permanent deformation.

A further disadvantage is that during this thermal treatment vaporization or oxidation of the mirror may occur. Especially for the parabolic mirror this can hardly be avoided.

Another disadvantage is that reflections occur at the flat plate, which give rise to rays falling outside the beam. In the lamp according to the said Offenlegungsschrift, this is avoided by a special step which consists in that a light-absorbing coating is provided.

A further disadvantage is that lamps having a lamp envelope of pressed glass are heavy and so require very stable luminaires in order that they can be directed to an object to be illuminated. Another disadvantage is that metal cups must be pressed into the glass to provide the possibility of connecting current supply conductors thereto. The process of pressing these metal cups into the glass may lead to a high rejection percentage. A further disadvantage is that as pressed glass only more expensive glasses having a low coefficient of expansion can be used.

On the contrary the lamp according to the invention has a lamp envelope which is obtained by blowmoulding in one piece and the parts of which are therefore accurately aligned with respect to each other. The lamp envelope need not be thermally treated in the close proximity of a mirror. The lamp envelope does not comprise a flat part near the apex of the concave wall portion, which provides undesired reflections. The lamp envelope may be made of glass having a high coefficient of expansion, which is generally used for lamp envelopes and into which current-supply conductors can be readily sealed, while it has a smaller weight and is less expensive.

It should further be noted that the known lamps of pressed glass have on the inner side of the front glass an inwardly projecting edge around the spherical mirror-coated portion. It should be appreciated that such an edge cannot be provided in a blown envelope.

Figure 2:
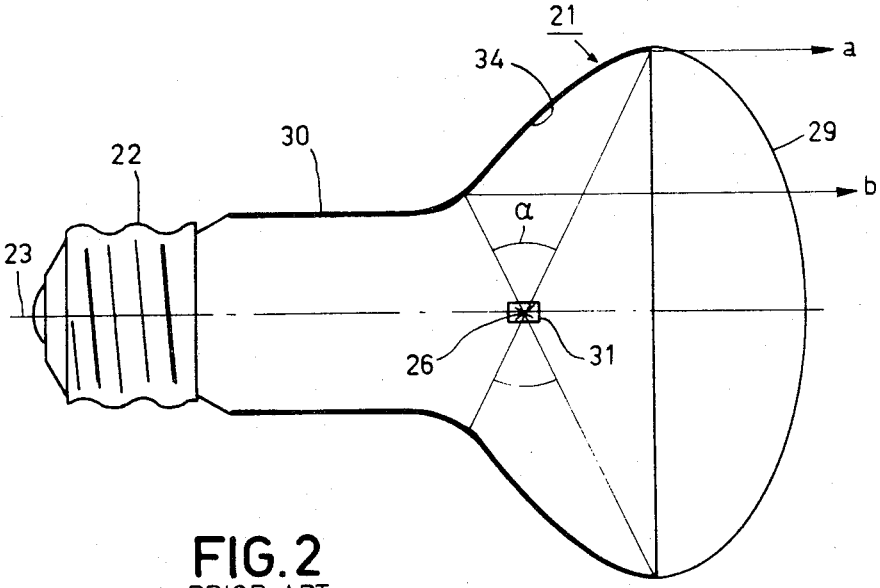
FIG. 2 PRIOR ART
Figure 3:
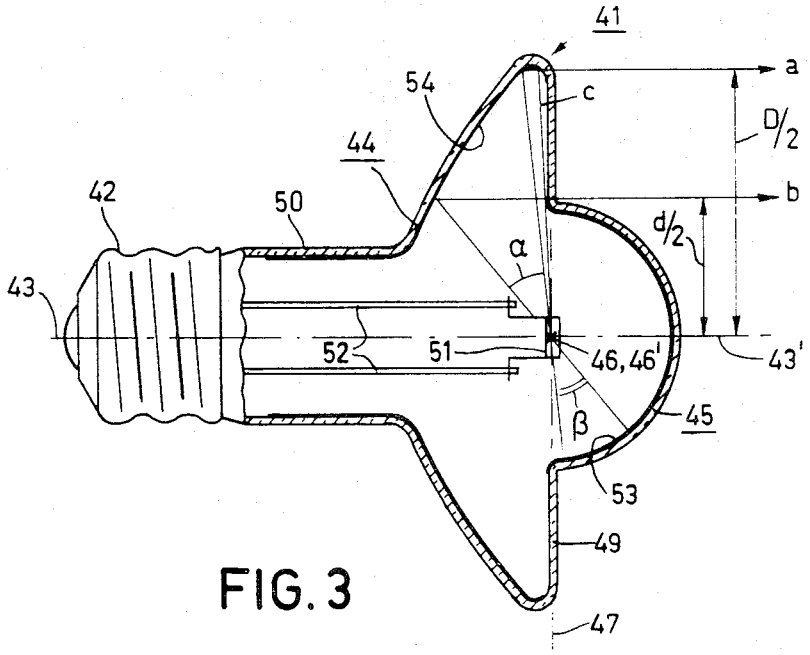
Figure 7:
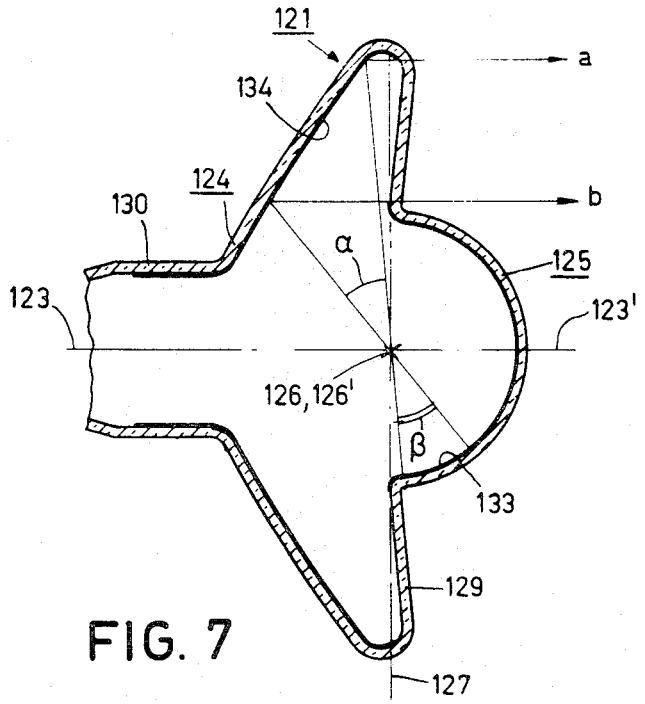
Figure 8:
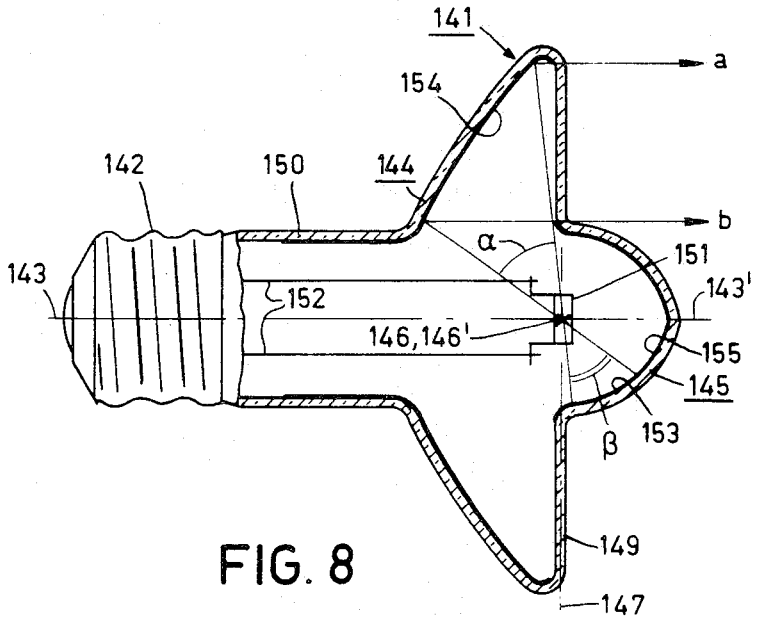

The lamp according to the invention is described more fully with reference to the drawings and embodiments of the lamp according to the invention are shown in the drawings, in which;

FIG. 1 shows the reflector lamp according to U.S. Pat. No. 1,436,308 in a side elevation, FIG. 2 shows a side elevation of a usual ring mirror lamp, the lamp envelope being shown in an axial sectional view, FIG. 3 shows diagrammatically a first embodiment of the lamp according to the invention in a side elevation, the lamp envelope being shown in an axial sectional view, FIGS. 4–7 each show in an axial sectional view a different embodiment of a lamp envelope of a lamp according to the invention, FIG. 8 shows diagrammatically a further embodiment in a side elevation, the lamp envelope being shown in an axial sectional view.

Figure 9:
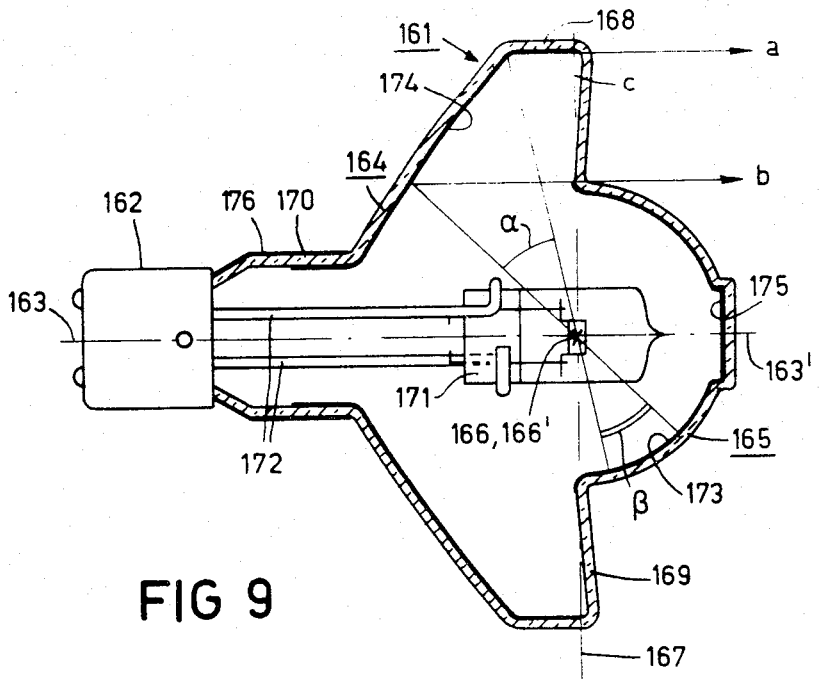
Figure 10:
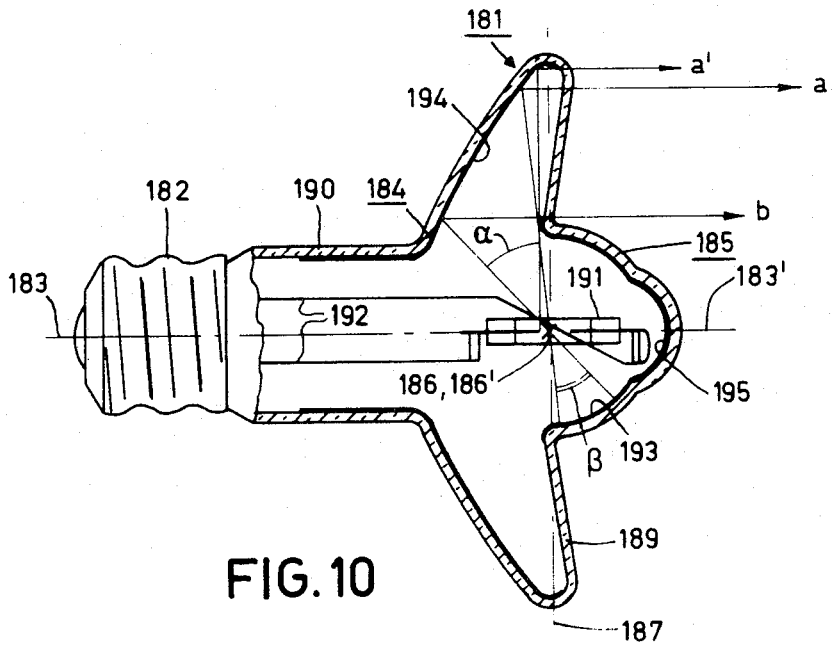

FIG. 9 shows a still further embodiment in a side elevation, the lamp envelope being shown in an axial sectional view, FIG. 10 shows a last embodiment in a side elevation, the lamp envelope being shown in an axial sectional view.

In these figures mirror-coatings on the inner side of a lamp envelope are designated by thick solid lines.

In the lamp and in the method according to the invention, the substantially spherical wall portion is a mask which prevents light rays (other than after reflection) or vapor radiation from reaching the window. Nevertheless the geometry of the lamp envelope at the area of the window may differ greatly.

The internal surface of the window may be situated in a flat plane which extends along the focal plane of the lamp envelope on the side of that plane remote from the spherical wall portion. FIGS. 3 and 8 show this geometry.

The internal surface of the window may alternatively be positioned at an angle to the focal plane.

Figure 4:
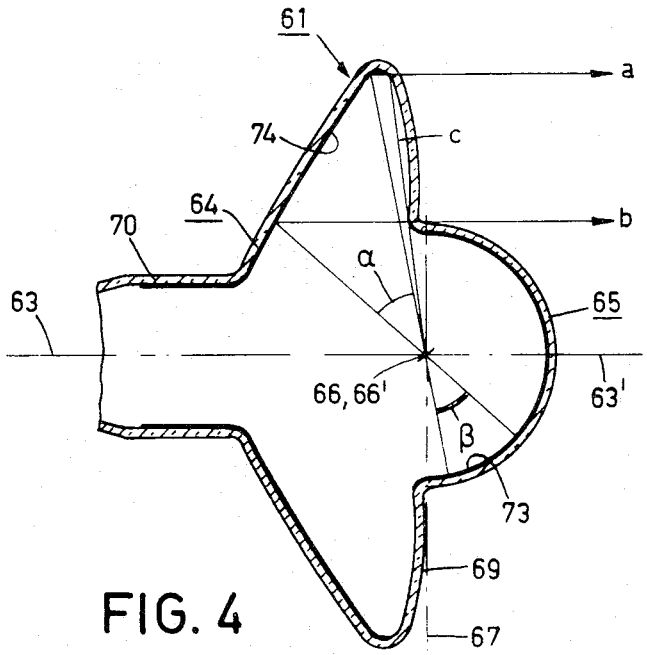

The internal surface of the window may then be wholly situated on the side of the focal plane remote from the spherical wall portion and may move, viewed from the axis of the lamp envelope, gradually further from the focal plane. Such a geometry is shown in FIG. 4.

Figure 5:
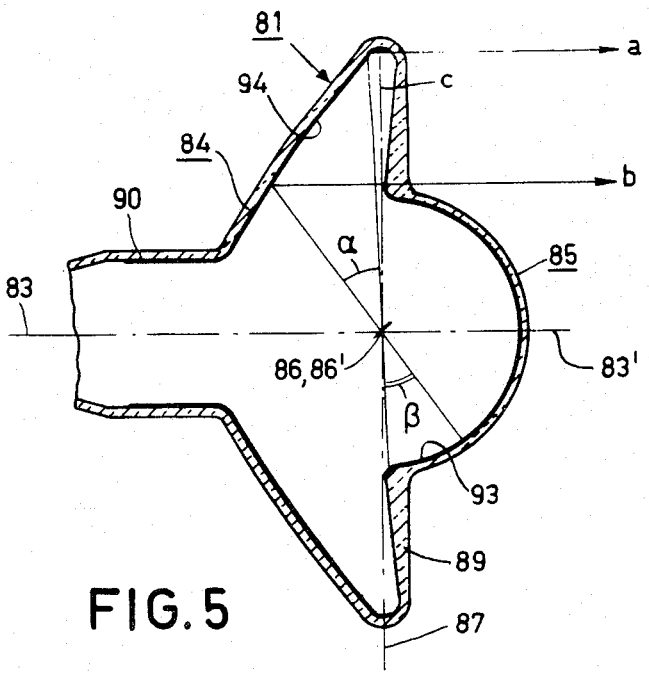
Figure 6:
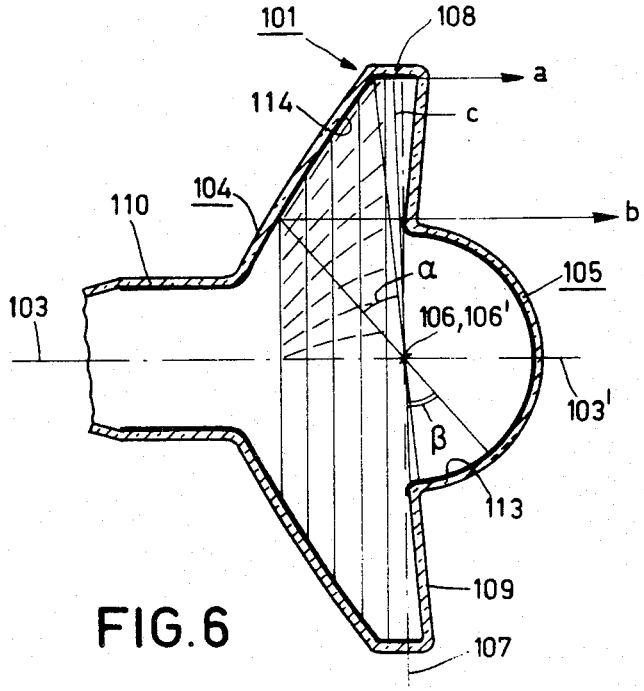

The internal surface of the window may alternatively be situated, however, at least for the major part on the side of the focal plane facing the spherical wall portion. The internal surface then extends from the focal plane in the proximity of the inner edge of the window as far as a large distance from the focal plane in the proximity of the outer edge of the window. Such a geometry is shown in FIG. 5 and FIG. 9. In a modification thereof the focal plane intersects the internal surface of the window. Such a geometry is shown in FIGS. 6, 7 and 10.

In practice there are neither light sources nor vapor sources having the size of a point. If a light source extends further from the focus in the direction of the tubular portion, the geometry of the lamp vessel at the area of the window is adapted thereto, which is shown inter alia in FIG. 10. It may also be desirable to position, when providing, the mirror coatings, the metal vapor source so that it is just displaced towards the tubular wall portion with respect to the light source.

The figures will be described below in greater detail.

The known lamp of FIG. 1 has a blown glass envelope 1, a lamp cap 2, an internally concave wall portion 4 having an optical axis 3 and a focus 6. Opposite the concave wall portion there is arranged a spherical wall portion 5, the axis 3' of which coincides with the axis 3, whereas the center of curvature 6' of which coincides with the focus 6. The largest external dimension of the spherical wall portion transverse to the axis is smaller than the largest internal dimension of the concave wall portion transverse to the axis. The wall portions are both externally mirror-coated. Between these two wall portions there is arranged an annular translucent wall portion 9 and a tubular wall portion 10 extends from the apex of the concave wall portion 4 to the exterior. A light source 11 surrounds the points 6 and 6'.

The concave wall portion 4 is substantially spherically curved, the point 6 serving as the center of curvature, while for a relatively small part 14 this portion is parabolic, the point 6 serving as the focus, It is apparent from the figure that only a small part 13 of the spherical mirror 5 co-operates with the parabolic part 14 and that these parts surround the light source 11 only through a small solid angle of only $1.3\pi$ sr. It further appears that the light source 11 is practically fully visible through the window 9.

As a result of the double reflections due to the external mirror-coating, the lamp is less effective than is already apparent from the said small space angle. The lamp emits stray light in transverse direction, while the mirror-coatings are liable to damage.

The known ring mirror lamp of FIG. 2 has a lamp envelope 21 having a lamp cap 22 and an optical axis 23. A parabolic wall portion 34 is internally mirror-coated and has a focus 26 around which a light source 31 is arranged. A tubular wall portion 30 extends from the apex of the parabola to the exterior, while opposite thereto a transparent wall portion 29 joins the parabolic wall portion. The figure shows the solid angle $\alpha$ of $1.5\pi$ sr, through which the parabolic mirror-coated wall portion 34 surrounds the light source 31. It appears from a comparison of FIGS. 1 and 2 that the lamp of FIG. 2 concentrates the light generated much more effectively. The lamp also emits unconcentrated light, it is true, but not in transverse direction, as the lamp of FIG. 1, but only at an acute angle to the axis 33.

The lamp according to the invention of FIG. 3 has a lamp envelope 41 comprising a lamp cap 42 and an internally concave substantially parabolic wall portion 44 having an optical axis 43 and a focus 46. From the apex of the parabolic wall portion 44 a tubular wall portion 50 extends to the exterior. Opposite the parabolic wall portion 44 there is arranged a substantially spherical wall portion 45, the axis 43' and the center of curvature 46' of which at least substantially coincide with the axis 43 and the focus 46, respectively. The parabolic wall portion 44 and the spherical wall portion 45 are internally mirror-coated. Between the two wall portions is located an annular translucent wall portion 49, the window. A light source 51 surrounds the points 46 and 46'. The largest internal dimension D of the parabolic wall portion is larger than the largest external diameter d of the spherical wall portion. The said four wall portions constitute a single blow moulding. The part 53 of the spherical wall portion 45 and the part 54 of the parabolic wall portion 44, which throw light rays from the light source 51 onto the window after at most two reflections, surround the light source 51 through solid angle $(\alpha+\beta)$ of $2.4\pi$ sr. The substantially spherical wall portion 45 constitutes a mask which prevents light rays originating from the light source substantially completely from reaching the window other than after reflection.

The light rays a and b constitute the outer and inner rays, respectively, of the emitted light beam. The ray c is the foremost light ray which is not screened by the spherical wall portion 45. This ray is incident, however, on the rounded transition between the parabolic wall portion 44 and the window 49 and does not emanate through the window 49.

The internal surface of the window 49 lies in a flat plane which extends along the focal plane 47 on the side remote from the spherical wall portion 45.

In FIGS. 4 to 10 corresponding parts are designated by a reference numeral which each time is 20 higher than in the immediately preceding figure.

In FIG. 4 the window 69 is internally concavely curved. The internal surface is located wholley on the side of the focal plane 67 remote from the spherical wall portion 65 and moves away from this plane from the inner edge of the window towards its outer edge. In this figure, the solid angle $\alpha+\beta$ is $2.4\pi$ sr.

In FIG. 5, the solid angle $\alpha+\beta$ is likewise $2.4\pi$ sr. The internal surface of the window 89 touches the focal plane 87 at the inner edge of the window and moves on the side of the focal plane facing the spherical wall portion gradually away from this plane towards the outer edge.

In FIG. 6, the parabolic wall portion 104 is connected through a tubular wall portion 108 to the window 109. Thus, a parabola having a greater focal distance could be used with the same largest diameter of the lamp envelope 101. The parts 113 and 114 of the spherical wall portion 105 and the parabolic wall portion 104, respectively, surround the focus 106 and tthe center of curvature 106' through a space angle of $2.4\pi$ sr. The optically effective part 114 of the parabolic wall portion 104 is facetted to prevent the light source from being displayed.

In FIG. 7, the wall portion 124 is elliptic. The distance between the foci of the ellipse is 10 m. The eccentricy of the ellipse is 0.1. The solid angle $\alpha+\beta$ is $2.4\pi$ sr.

The internal surface of the window 129 intersects the focal plane 127 and moves from the intersection towards the outer edge of the window away from this focal plane on its side facing the spherical wall portion.

In FIG. 8, the lamp envelope 141 shows a great resemblance to that of FIG. 3. The largest transverse dimension of the spherical wall portion 145 is, however, considerably smaller. Consequently, the solid angle $\alpha+\beta$ in this figure is $2.7\pi$ sr. Around and near the axis 143' the spherical wall portion is curved with a larger radius of curvature (part 155), as a result of which the wall portion 145 has obtained an ogival form and a larger depth. A filament 151 is fed through currentsupply conductors 152.

In FIG. 9, the lamp envelope 161 shows resemblance to that of FIG. 6. The spherical wall portion 165 has a sleeve-shaped protuberance 175 around and near its axis 163'. The light source 171 is constituted by a halogen burner: a filament in an inner envelope which is filled with a halogen-containing gas. The tubular part 170 of the lamp envelope is externally provided with a non-transparent coating 176.

In this figure, $\alpha$ and $\beta$ together enclose a solid angle of $2.0\pi$ sr.

In FIG. 10, the light source 191 is a discharge vessel comprising a high-pressure sodium vapor discharge. The outer light rays from the focus 186 and the center of curvature 186' enclose a solid angle $\alpha+\beta$ of $2.7\pi$ sr. Since the light source is extended in axial direction, a further light ray a', which contributes to the emitted beam, emanates from the apex of one of the electrodes.

The spherical wall portion 185 has a spherical protuberance 195 around and near its axis 183', which can accommodate the light source 191, The protuberance is located in the optically non-effective part of the spherical wall portion.

EXAMPLE

In a practical case, a lamp according to the invention had a lamp envelope in the shape of FIG. 3. The lamp envelope was filled with inert gas. Data regarding the lamp envelope, the life, the power of the filament and the light beam are recorded in Table I in comparison with ring mirror lamps (R) of FIG. 2, a Par 38 pressed glass lamp and a combination of a bowl mirror lamp and a reflector. All lamps were operated at 220 V.

TABLE I

| lamp | ϕ parabola (mm) | solid angle (sr) | life (hr) | W (Watt) | Io[x] (cd) | ½ Io[xx] at angle of |
|---|---|---|---|---|---|---|
| 1 | 75 | 2,4π | 2000 | 25 | 900 | 8° |
| 2 | 95 | 2,4π | 2000 | 60 | 3200 | 8° |
| R | 51 | 1,5π | 1000 | 25 | 200 | 16° |
| R | 63,5 | 1,5π | 1000 | 60 | 850 | 15° |
| PAR | 122 | 2,3π | 2000 | 75 | 3200 | 8° |
| l/refl. comb. | 150 | 2,9π | 1000 | 60 | 3375 | 9° |

[x]Light flux on the axis of the beam.
[xx]Light flux = ½ Io in directions enclosing the designated angle with the axis.

Lamps having a lamp envelope in the shape of FIG. 9 were provided with a filament in an inner envelope and a halogen-containing gas filling (Hal) or with a nonenveloped filament surrounded by inert gas. The lamps were compared with a ring mirror lamp of FIG. 2, Par 38 pressed glass lamps and a combination of a bowl mirror lamp and a reflector; in the latter combination the bowl mirror and the reflector; in the latter combination the bowl mirror and the reflector were accurately aligned with respect to each other. The lamps were operated at 220 V. The results are recorded in Table II.

TABLE II

| lamp | ϕ parabola (mm) | solid angle (sr) | life (hr) | W (watt) | Io[x] (cd) | ½ Io[xx] at angle of |
|---|---|---|---|---|---|---|
| 3 Hal | 91 | 2,4 | 2000 | 100 | 9600 | 7°; 4°* |
| 4 Hal | 91 | 2,4 | 2000 | 75 | 8400 | 6°; 4°* |
| 5 | 91 | 2,4 | 2000 | 100 | 5500 | 9°; 7,5°* |
| R | 95 | 1,5 | 1000 | 100 | 1750 | 15° |
| PAR | 122 | 2,3 | 2000 | 75 | 3200 | 8° |
| PAR | 122 | 2,3 | 2000 | 100 | 4600 | 8° |
| PAR | 122 | 2,3 | 2000 | 150 | 7500 | 8° |
| l/refl. comb. | 190 | 3,2 | 1000 | 100 | 10.000 | 8° |

[x]These lamps have a light beam which is not equally wide in two orthogonal planes through the axis of the lamp.

These lamps according to the invention were manufactured by arranging in a lamp envelope according to FIG. 3 and FIG. 9, respectively, via the tubular wall portion 50 and 170, respectively, an aluminium vapor source so as to surround the focus and the centre of curvature. The lamp envelope was evacuated, flushed with inert gas and evacuated to 0.1 Pa. Subsequently, the vapor source was put into operation and the wall portions 44,45 and in part 50 and the wall portions 164, 165, 168 and in part 170, respectively, were mirror-coated. The spherical wall portion 45 and 165, respectively, then constituted a mask which screened the window 49 and 149, respectively, from the vapor source.

Subsequently, the gas pressure was brought to 1 bar, the vapor source was removed and the light source 51 and 171, respectively, was arranged around the focus and the center of curvature. The lamp envelope was evacuated, provided with inert gas and sealed, Subsequently, the lamp cap was provided. When the lamps were put into operation, the data recorded in the Table were measured and it was found that the lamps did not emit unreflected light through the window.

What is claimed is:

1. An electric reflector lamp comprising a lamp envelope having an interior and an exterior, said lamp envelope having a first, mirror-coated internally concave wall portion having an optical axis and a first focus and opposite thereto a second, mirror-coated substantially spherical wall portion, said second wall portion having an axis and a center of curvature, said axis and said center of curvature of said second wall portion substantially coinciding with said optical axis and said first focus, respectively, of said internally concave wall portion, the largest external dimension of said second wall portion transverse to said axis being smaller than the largest internal dimension transverse to said optical axis of said internally concave wall portion, a third, annular translucent wall portion between said internally concave wall portion and said spherical wall portion and a fourth, tubular wall portion extending from the apex of the internally concave wall portion to said exterior, said wall portions together constituting a single blow moulding, said lamp envelope accommodating a light source which surrounds said first focus and said center of curvature and from which current-supply conductors extend through said wall of said lamp envelope to said exterior, said internally concave wall portion and said substantially spherical wall portion being internally mirror-coated, said internally concave wall portion being substantially elliptic, a second focus lying outside said lamp envelope and those parts of said mirror-coated wall portions, which throw light rays from said light source onto said translucent wall portion after at most two reflections, surrounds the center of curvature and said first focus through a solid angle of more than 1.5 times 3.1416 steradians, and said substantially spherical wall portion constituting a mask which substantially prevents light rays originating from said light source from reaching said translucent wall portion other than after reflection.

2. An electric reflector lamp as claimed in claim 1, characterized in that said spherical wall portion bulges outwardly around said axis.

3. An electric reflector lamp as claimed in claim 1, characterized in that a tubular nontransparent wall portion connects said internally concave wall portion to said annular translucent wall portion.

4. An electric reflector lamp as claimed in claim 3, characterized in that the internal surface of said translucent wall portion extends along a focal plane of said lamp envelope on the side of said focal plane remote from said spherical wall portion.

5. An electric reflector lamp as claimed in claim 1, characterized in that said internal surface of said translucent wall portion is fully disposed on the side of said focal plane remote from said spherical wall portion from its inner edge towards its outer edge and gradually moves away from said focal plane.

6. An electric reflector lamp as claimed in claim 5, characterized in that the internal surface of said translucent wall portion proximate to its outer edge thereof extends further away from said focal plane on the side of said plane facing said spherical wall portion.

7. An electric reflector lamp as claimed in claim 6, characterized in that the internal surface of said translucent wall portion intersects said focal plane.

8. An electric reflector lamp comprising a lamp envelope having an interior and an exterior, said lamp envelope having a first, mirror-coated internally concave wall portion having an optical axis and a focus and opposite thereto a second, mirror-coated substantially spherical wall portion, said second wall portion having an axis and a center of curvature, said axis and said center of curvature of said second wall portion substantially coinciding with said optical axis and said focus, respectively, of said internally concave wall portion, the largest external dimension of said second wall portion transverse to said axis being smaller than the largest internal dimension transverse to said optical axis of said internally concave wall portion, a third, annular translucent wall portion between said internally concave wall portion and said spherical wall portion and a fourth, tubular wall portion extending from the apex of the internally concave wall portion to said exterior, said wall portions together constituting a single blow moulding, said lamp envelope accommodating a light source which surrounds said focus and said center of curvature and from which current-supply conductors extend through said wall of said lamp envelope to said exterior, said internally concave wall portion and said substantially spherical wall portion being internally mirror-coated, said internally concave wall portion being substantially parabolic, those parts of said mirror-coated wall portions, which throw light rays from said light source onto said translucent wall portion after at most two reflections, surrounding the center of curvature and said focus through a solid angle of more than 1.5 times 3.1416 steradians, and said substantially spherical wall portion constituting a mask which substantially prevents light rays originating from said light source from reaching said translucent wall portion other than after reflection.

* * * * *